US008540234B2

(12) United States Patent
Akatsuka et al.

(10) Patent No.: US 8,540,234 B2
(45) Date of Patent: Sep. 24, 2013

(54) IMAGE FORMING APPARATUS

(75) Inventors: Yasunori Akatsuka, Nagoya (JP); Tomitake Aratachi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/617,532

(22) Filed: Sep. 14, 2012

(65) Prior Publication Data

US 2013/0134656 A1 May 30, 2013

(30) Foreign Application Priority Data

Nov. 24, 2011 (JP) ..... 2011-256501

(51) Int. Cl.
*B65H 1/08* (2006.01)
*B65H 1/14* (2006.01)

(52) U.S. Cl.
USPC ..... 271/127; 271/156; 271/147; 271/152

(58) Field of Classification Search
USPC ..... 271/156, 127, 147, 152
See application file for complete search history.

(56) References Cited

U.S. PATENT DOCUMENTS

2010/0104311 A1 4/2010 Okamoto
2011/0180985 A1 7/2011 Yamamoto

FOREIGN PATENT DOCUMENTS

JP 2010-105768 5/2010
JP 2011-153014 8/2011

*Primary Examiner* — Luis A Gonzalez
(74) *Attorney, Agent, or Firm* — Banner & Witcoff, Ltd.

(57) ABSTRACT

An image forming apparatus is provided that includes a swing member swinging between a first position where a force for moving a pressing plate upward is transmitted to the pressing plate and a second position where transmission of the force is interrupted, a latchet mechanism that forbids the pressing plate to move downward and includes a latchet gear rotating in conjunction with a motion of the pressing plate and a latching member that is movably attached to the swing member and configured to forbid rotation of the latchet gear by engaging with the latchet gear, and a pressing member that applies a pressing force to the latching member when the swing member is in the second position and does not apply the pressing force to the latching member, and render the latching member movable relative to the swing member when the swing member is in the first position.

8 Claims, 11 Drawing Sheets

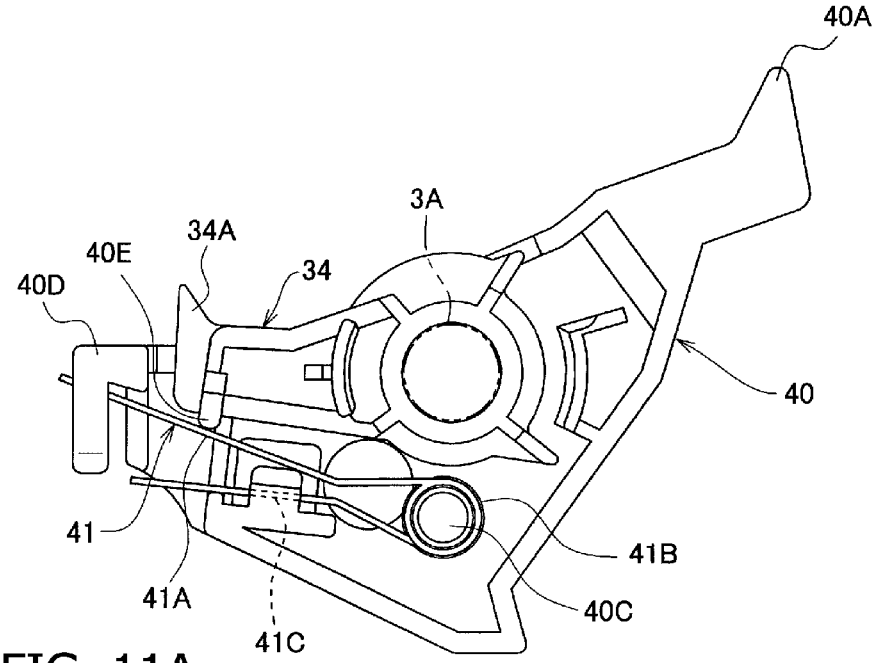
FIG. 11A SECOND POSITION
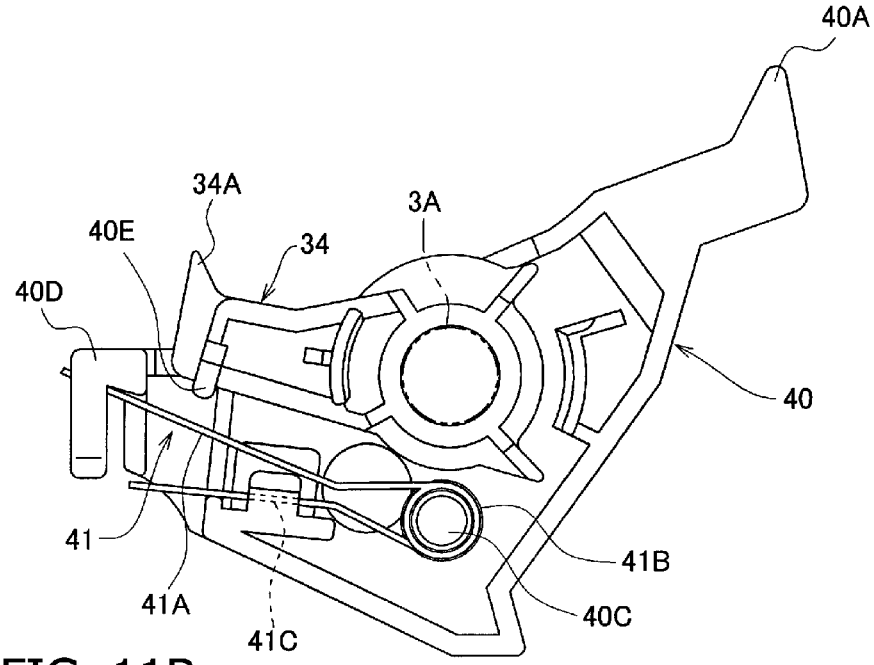
FIG. 11B FIRST POSITION

IMAGE FORMING APPARATUS

Cross-Reference to Related Application

This application claims priority under 35 U.S.C. §119 from Japanese Patent Application No. 2011-256501 filed on Nov. 24, 2011. The entire subject matter of the application is incorporated herein by reference.

BACKGROUND

1. Technical Field

The following description relates to one or more techniques for an image forming apparatus having a function to sequentially feed a plurality of sheets placed on a loading unit such as a sheet tray.

2. Related Art

An image forming apparatus has been known that is provided with a pickup roller disposed above a feed tray and configured to prevent a lowered contact surface pressure between the pickup roller and sheets left on the feed tray by lifting a pressing plate in response to reduction in the number of the sheets left on the feed tray.

Further, the known image forming apparatus is configured to switch a power transmission state between a state where a force for lifting the pressing plate is transmitted to the side of the pressing plate and another state where the transmission of the force is interrupted, by swinging a swing member such as a stop arm. At this time, a known latchet mechanism, which includes a latchet gear and a latching member, prevents the pressing plate from moving down when the transmission of the force is interrupted.

Hereinafter, the position of the swing member in a situation where the force is transmitted to the side of the pressing plate will be referred to as a first position. In addition, the position of the swing member in a situation where the transmission of the force is interrupted will be referred to as a second position.

Nonetheless, when the force is transmitted to the side of the pressing plate and the pressing plate is lifted in a state where the latchet gear is engaged with the latching member, the latchet gear rotates in conjunction with the upward motion of the pressing plate. Then, when a tooth portion of the latchet gear collides against the latching member, an abnormal clattery sound is generated.

Thus, to prevent the abnormal clattery sound, the known image forming apparatus is configured (a) to cause an elastic member to always press the latching member against the latchet gear and (b) to render the latching member separate from the latchet gear by making a contact portion provided to the swing member collide against the latching member when the swing member swings from the second position to the first position.

SUMMARY

In the meantime, when the latchet gear rotates more than a width of a groove between adjacent teeth thereof (hereinafter referred to as a "tooth groove width") since the swing member has swung to the first position, the latching member climbs over the tooth portion of the latchet gear so as to cause a collision between the tooth portion of the latchet gear and the latching member.

Therefore, a separation moment when the latching member is rendered separate from the latchet gear is required to be (A) the same moment as when the swing member swings to the first position or (B) a moment before the latchet gear rotates as much as the tooth groove width since the swing member has swung to the first position.

Meanwhile, in the aforementioned known image forming apparatus, the separation moment is determined based on dimensions such as the external dimensions and positional dimensions of the contact portion and the latching member and the tooth groove width of the latchet gear. Therefore, to satisfy the aforementioned requirements concerning the separation moment, manufacturing processes for components such as the contact portion, the latching member, and the latchet gear need to be strictly managed to reduce variations in the external dimensions and positional dimensions of the components.

However, the strictly-managed manufacturing processes for the components such as the contact portion, the latching member, and the latchet gear might lead to increased manufacturing costs of the components. Consequently, it might result in an increased manufacturing cost of the image forming apparatus.

Aspects of the present invention are advantageous to provide one or more improved techniques for an image forming apparatus that make it possible to prevent occurrence of an abnormal sound by separating a latching member from a latchet gear at an appropriate moment and avoid a rise in the manufacturing cost of the image forming apparatus.

According to aspects of the present invention, an image forming apparatus is provided that includes an image forming unit configured to form an image on a sheet, a loading unit configured to be loaded with a plurality of sheets stacked thereon, a feed roller disposed above the loading unit, the feed roller being configured to contact the sheets stacked on the loading unit and feed the sheets toward the image forming unit, a pressing plate configured to move upward the sheets stacked on the loading unit, a swing member configured to swing between a first position where a force for moving the pressing plate upward is transmitted to the pressing plate and a second position where transmission of the force to the pressing plate is interrupted, a latchet mechanism configured to forbid the pressing plate to move downward, the latchet mechanism including a latchet gear configured to rotate in conjunction with a motion of the pressing plate, and a latching member movably attached to the swing member, the latching member being configured to forbid rotation of the latchet gear by engaging with the latchet gear, and a pressing member configured to apply to the latching member a pressing force to press the latching member against the latchet gear when the swing member is in the second position, and not to apply the pressing force to the latching member, and render the latching member movable relative to the swing member when the swing member is in the first position.

BRIEF DESCRIPTION OF THE ACCOMPANYING DRAWINGS

FIGS. 7, 8, 9, and 10 illustrate operations of the lifting mechanism in the embodiment according to one or more aspects of the present invention.

FIGS. 11A and 11B illustrate operations of the latching member and an elastic member attached to the swing member in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings. It is noted that, in the embodiment, aspects of the present invention are applied to an electrophotographic image forming apparatus.

1. Overall Configuration of Image Forming Apparatus

Figure 1:
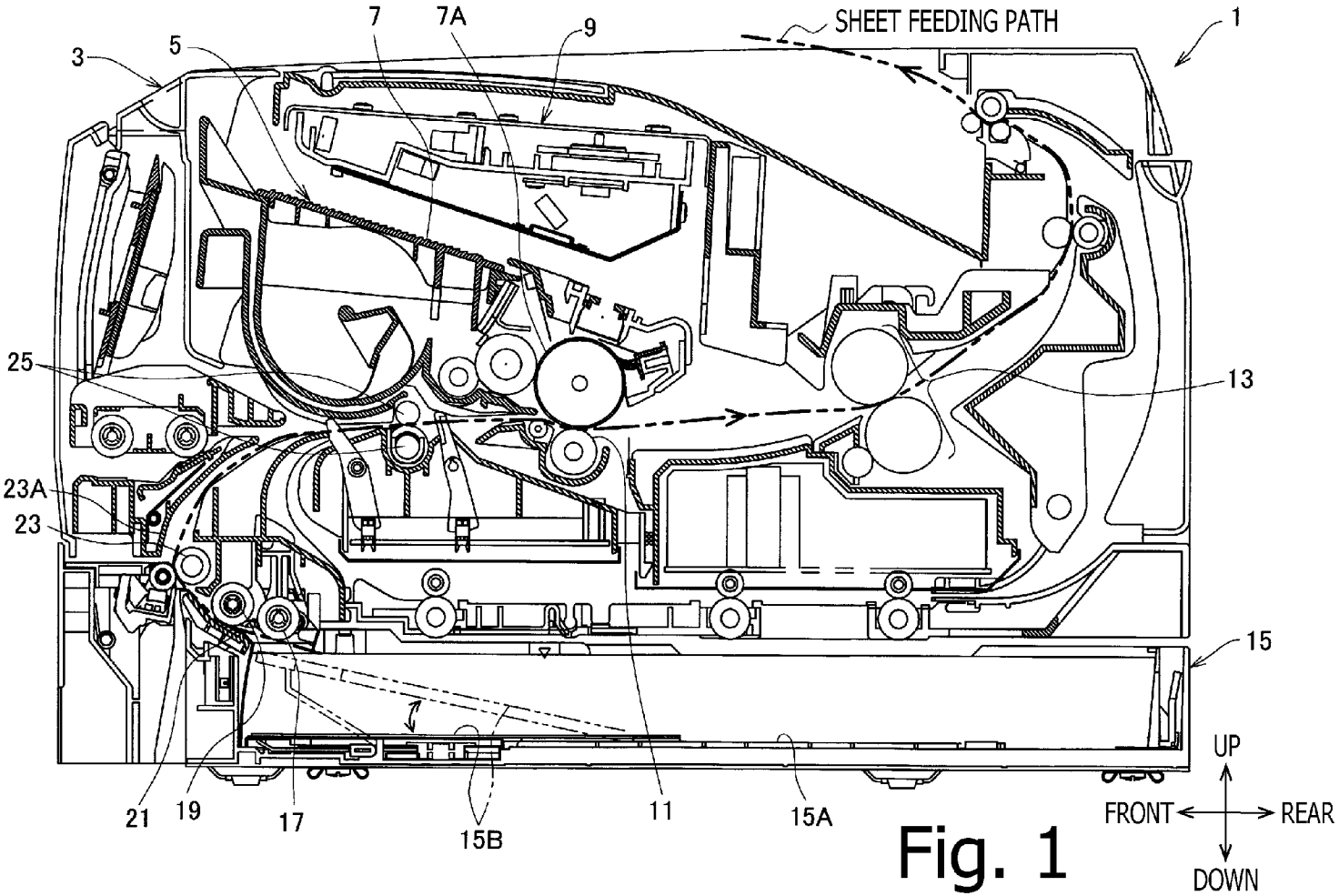
FIG. 1 is a cross-sectional side view showing a configuration of an image forming apparatus in an embodiment according to one or more aspects of the present invention.

As shown in FIG. 1, an image forming apparatus 1 includes, in a housing 3 thereof, a monochrome image forming unit 5 configured to form an image on a sheet such as a recording sheet and a transparency by transferring a developer image onto the sheet.

The image forming unit 5 includes a process cartridge 7 that forms a development unit, an exposure unit 9 configured to expose a photoconductive drum 7A, a transfer roller 11 configured to transfer a developer image formed on the photoconductive drum 7A onto the sheet, and a fuser 13 configured to heat and fix the developer image transferred onto the sheet.

Further, a feed tray 15 includes a loading unit 15A configured such that sheets to be fed to the image forming unit 5 are stacked thereon. The feed tray 15 is detachably attached to an apparatus main body, that is, the housing 3. Specifically, in the embodiment, the feed tray 15 is attached to or detached from the apparatus main body when moved along a front-to-rear direction.

The sheets placed on the loading unit 15A are fed toward the image forming unit 5 by a pickup roller 17, separated on a sheet-by-sheet basis by a separation roller 19 and a separation pad 21, and then conveyed to the image forming unit 5.

The pickup roller 17 is disposed above the feed tray 15 in the apparatus main body. The pickup roller 17 is configured to contact a top one of sheets placed on the loading unit 15A from above and feed the sheets toward the image forming unit 5.

The separation pad 21 is disposed in a position opposed to the separation roller 19 and configured to apply a feeding resistance to the sheets. Meanwhile, the separation roller 19 is configured to rotate in contact with the top one of the sheets and apply a feeding force to the top sheet. Therefore, even when a plurality of sheets are fed from the pickup roller 17 toward the image forming unit 5, the plurality of sheets are separated and fed to the image forming unit 5 on a sheet-by-sheet basis.

Further, the sheet fed out from the separation roller 19 is fed by a feeding roller 23, and the feeding direction of the sheet is turned up and around by a feeding chute 23A. After that, a skew correction is performed for the sheet by two registration rollers 25, and then, the sheet is fed to the image forming apparatus 5 at a predetermined moment.

Figure 2:
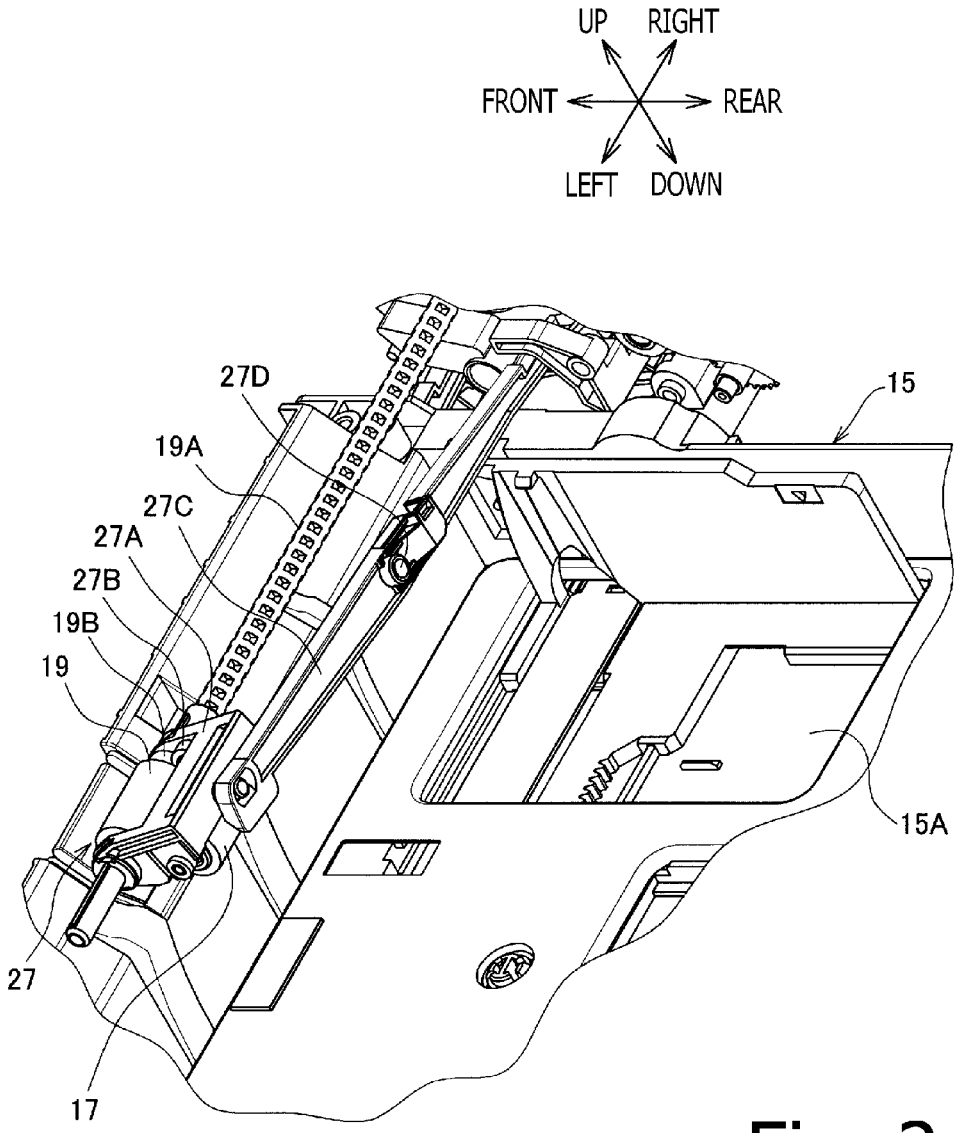
FIG. 2 shows a configuration of a part of the image forming apparatus around a pickup roller and a separation roller in the embodiment according to one or more aspects of the present invention.

As shown in FIG. 2, the pickup roller 17 and the separation roller 19 are integrated via a roller holder 27A to form a roller unit 27. A driving gear 19B configured to rotate integrally with the separation roller 19 is provided at an end of the separation roller 19 in an axial direction of the separation roller 19, which end is on the same side as a driving shaft 19A.

Further, a driven gear configured to rotate integrally with the pickup roller 17 is provided at an end of the pickup roller 17 in an axial direction of the pickup roller 17, which end is on the same side as the driving gear 19B. It is noted that FIG. 2 does not show the driven gear or a driving source (such as an electric motor) configured to provide a driving force to the driven shaft 19A.

An intermediate gear 27B configured to engage with the driving gear 19B and the driven gear is rotatably attached to the roller holder 27A. Therefore, when the driving shaft 19A rotates, and the separation roller 19 rotates, a rotational force is transmitted from the driving gear 19B to the driven gear via the intermediate gear 27B, and the pickup roller 17 is rotated.

The roller holder 27A is rotatable around an axis line of the separation roller 19, and the intermediate gear 27B is rotatably supported by the roller holder 27A. Therefore, when the separation roller 19 rotates in a state where the pickup roller 17 is not in contact with the sheet, that is, in a state where the roller holder 27A is freely rotatable, the pickup roller 17 revolves around the separation roller 19 together with the roller holder 27A, without rotating.

When the pickup roller 17 comes into contact with the sheet such that the rotation of the roller holder 27A is regulated, the intermediate gear 27B begins to rotate relative to the roller holder 27A, and the pickup roller 17 begins to rotate. Thus, in the embodiment, when the rotational force is transmitted to the separation roller 19, the pickup roller 17 begins to rotate after revolving to such a position as to contact an upper surface of the sheets placed on the loading unit 15A.

Further, a roller swing arm 27C, which extends in a direction substantially parallel to the driving shaft 19A, is swingably linked with a side of the roller holder 27A that is close to the pickup roller 17. A middle portion in a longitudinal direction of the roller swing arm 27C is supported swingably relative to the apparatus main body. A first end (a left end) in the longitudinal direction of the roller swing arm 27C is linked with the roller holder 27A. A second end (a right end) in the longitudinal direction of the roller swing arm 27C extends up to the outside of the feed tray 15 in a width direction of the feed tray 15.

Therefore, when the pickup roller 17 (or the roller holder 27A) revolves to the side of the loading unit 15A, the roller swing arm 27C is swung such that the first end in the longitudinal direction thereof moves downward and the second end in the longitudinal direction thereof moves upward.

It is noted that the width direction is a direction perpendicular to a direction in which the sheet is fed by the pickup roller 17 and a thickness direction of the sheets placed on the loading unit 15A. In the embodiment, a left-to-right direction is defined as the width direction.

As shown in FIG. 1, at a bottom portion of the feed tray 15, there is provided a pressing plate 15B configured to move the sheets placed on the loading unit 15A upward, that is, toward the pickup roller 17. The pressing plate 15B is configured to swing upward in response to reduction in the number of the sheets placed on the loading unit 15A. Thereby, it is possible to maintain a contact surface pressure between the pickup roller 17 and the sheet within a predetermined range and to prevent a feeding failure of the pickup roller 17.

2. Lifting Mechanism of Pressing Plate 2. 1. Clutch Mechanism

Figure 3:
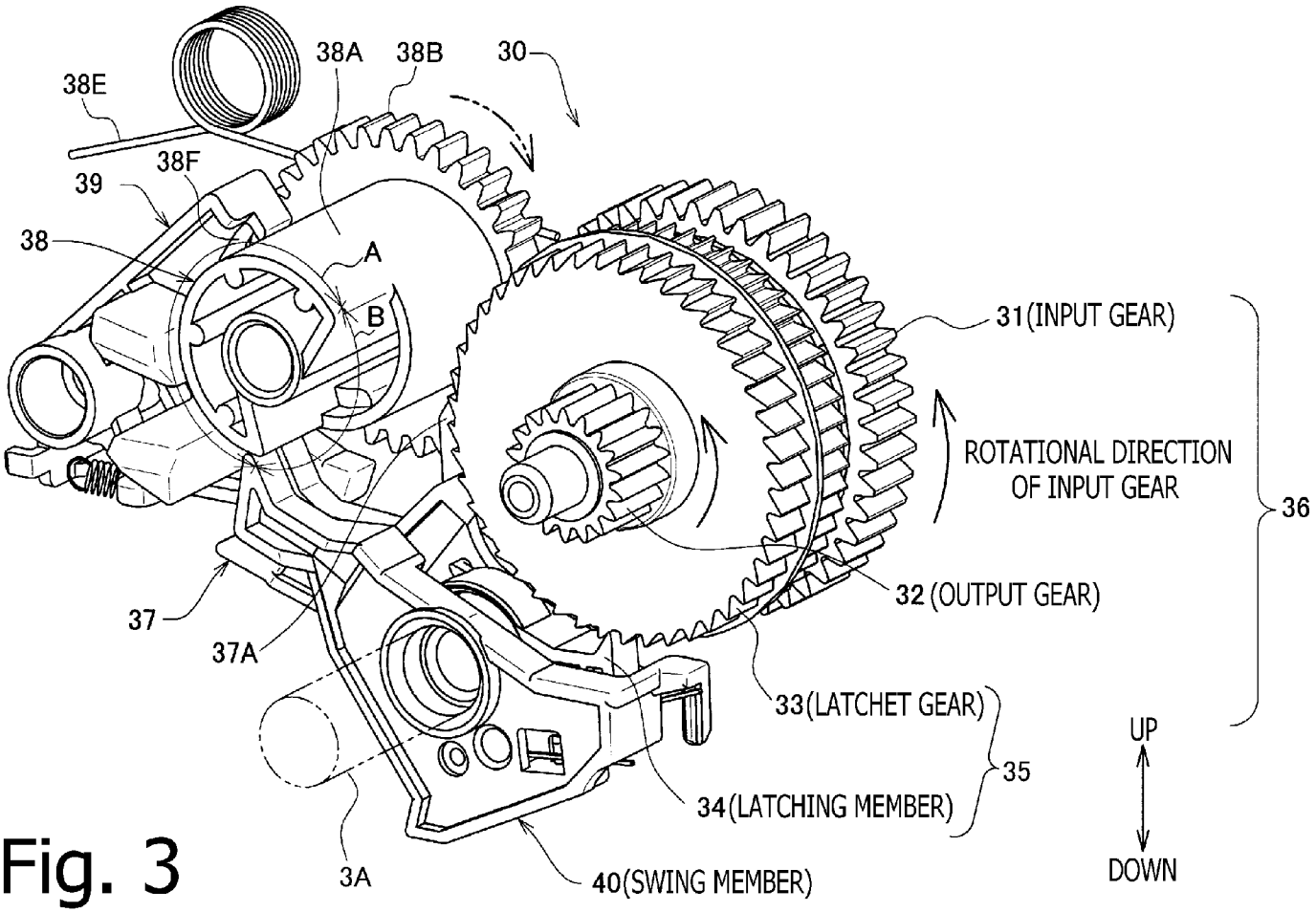
FIG. 3 is a perspective view showing a configuration of a lifting mechanism for lifting a pressing plate in the embodiment according to one or more aspects of the present invention.

As shown in FIG. 3, a lifting mechanism 30 for lifting the pressing plate 15B includes a plurality of gears. The lifting mechanism 30 is configured to move the pressing plate 15B upward by rotating a sector gear for lifting the pressing plate 15B by a previously-set angle when the second end in the longitudinal direction of the roller swing arm 27C moves upward. It is noted that the sector gear is not shown in FIG. 3.

An input gear 31 is configured to be supplied with a driving force from the aforementioned electric motor and rotate in synchronization with rotation of the electric motor. Therefore, the input gear 31 rotates when the electric motor rotates, regardless of the position of the pickup roller 17 (i.e., regardless of whether it is time to lift the pressing plate 15B).

An output gear 32 is configured to output and transmit the driving force to the sector gear. Hence, when the output gear 32 rotates, the pressing plate 15B moves upward. A latchet gear 33, together with a latching member 34, forms a latching mechanism 35.

The latchet mechanism is a known mechanism configured to allow the latchet gear 33 to rotate in one direction and forbid the latchet gear 33 to rotate in the other direction by engagement between the latchet gear 33 and the latching member 34.

Since the latchet gear 33 and the output gear 32 rotate integrally, the latchet gear 33 rotates in mechanical conjunction with movement of the pressing plate 15B. Accordingly, in the embodiment, by the latchet mechanism 35, the downward movement of the pressing plate 15B is restricted, and the upward movement of the pressing plate 15B is permitted. When the engagement between the latchet gear 33 and the latching member 34 is released, the pressing plate 15B is put into a state movable downward.

Further, in the embodiment, transmission/interruption of the driving force from the input gear 31 to the output gear 32 is carried out by a clutch mechanism 36 using a planetary gear mechanism. It is noted that the clutch mechanism 36 and the latchet gear 33 are rotatably attached to the apparatus main body.

Figure 4A:
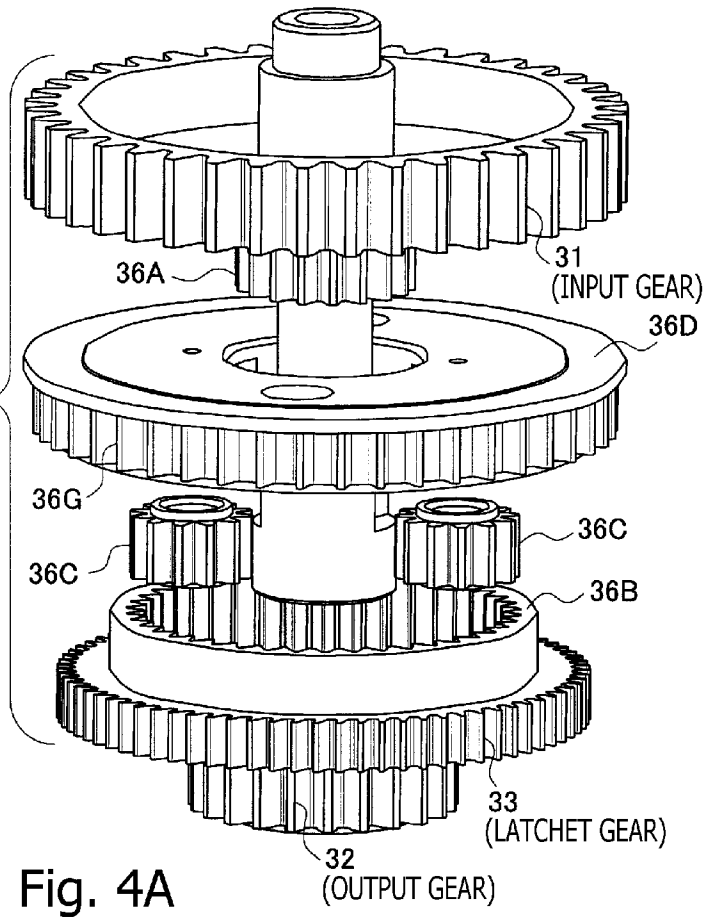
FIGS. 4A and 4B are exploded perspective views showing a configuration of a clutch mechanism in the embodiment according to one or more aspects of the present invention.

As shown in FIG. 4A, the clutch mechanism 36 includes a sun gear 36A, an inner gear 36B, planetary gears 36C, and a holder 36D. The sun gear 36A is rotated by the driving force transmitted via the input gear 31.

In the embodiment, the sun gear 36A and the input gear 31 are integrally formed of resin in a coaxially-arranged state. Therefore, the sun gear 36A rotates in synchronization with the aforementioned electric motor.

The inner gear 36B has a center line of rotation that is positionally coincident with a center line of rotation of the sun gear 36A. Further, the inner gear 36B includes teeth that are formed on a cylindrical inner circumferential surface and configured to engage with the planetary gears 36C. The driving force is transmitted from the inner gear 36B to the output gear 32.

In the embodiment, the inner gear 36B, the latchet gear 33, and the output gear 32 are integrally formed of resin in a coaxially-arranged state. Therefore, when the inner gear 36B rotates, the output gear 32 rotates, and the pressing plate 15B moves.

The planetary gears 36C are provided at an inner side of the inner gear 36B and configured to engage with the sun gear 36A and the inner gear 36B. In the embodiment, the two planetary gears 36C are disposed point-symmetrically with respect to the sun gear 36A.

Figure 4B:
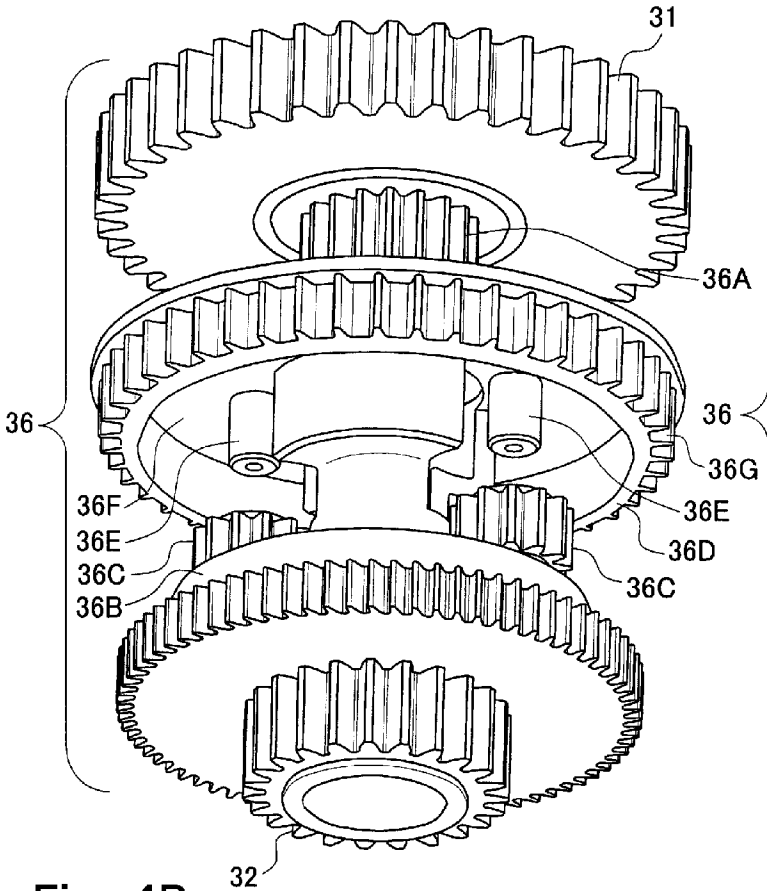

As shown in FIG. 4B, the holder 36D is configured to rotatably hold the planetary gears 36C such that each planetary gear 36C revolves around a center of rotation of the sun gear 36A. Specifically, the holder 36D includes holding shafts 36E each of which is configured to rotatably hold a corresponding one of the planetary gears 36C, and a holding plate 36F configured to support the holding shafts 36E such that each planetary gear 36C revolves around the center of rotation of the sun gear 36A.

Accordingly, when the holder 36D is permitted to rotate in a state where the sun gear 36A rotates, since a rotational resistance of the output gear 32 or the inner gear 36B is larger than a rotational resistance of the holder 36D, the two planetary gears 36C revolve around the sun gear 36A, but do not transmit the driving force to the inner gear 36B. Therefore, the transmission of the driving force from the inner gear 31 to the output gear 32 is interrupted.

Meanwhile, when the holder 36D is forbidden to rotate in a state where the sun gear 36A rotates, since the rotational resistance of the inner gear 36B is smaller than the rotational resistance of the holder 36D, the two planetary gears 36C rotate in their respective positions without revolving around the sun gear 36A. Therefore, the driving force is transmitted to the inner gear 36B. Thus, the driving force is transmitted from the inner gear 31 to the output gear 32.

2. 2. Control of Clutch Mechanism

<Details of Clutch Mechanism>

Figure 5:
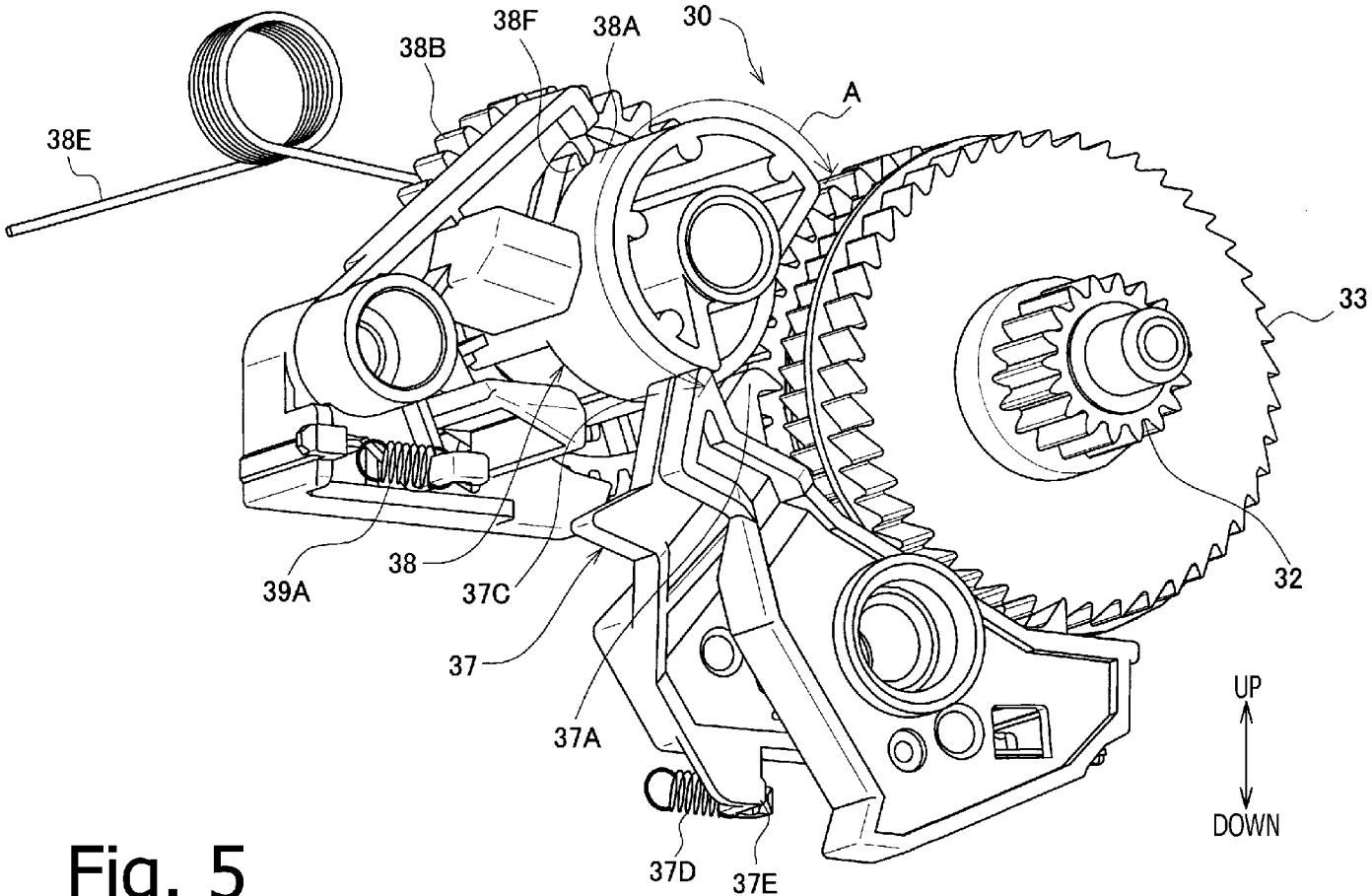
FIG. 5 is another perspective view showing the configuration of the lifting mechanism in the embodiment according to one or more aspects of the present invention.

As shown in FIGS. 4A and 4B, the holding plate 36F of the holder 36D includes an engagement portion G provided with a plurality of projections formed on a cylindrical outer circumferential surface of the holding plate 36F. As shown in FIG. 5, an engagement arm 37 configured to engage with the engagement portion 36G is attached to the apparatus main body. The engagement arm 37 is configured to move between an engagement position to engage with the engagement portion 36G and a separation position separated from the engagement portion 36G.

Figure 6A:
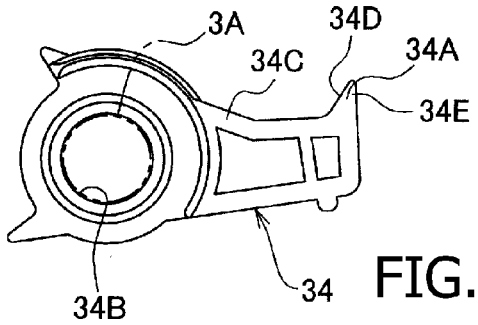
FIG. 6A is a front view showing a configuration of a latching member in the embodiment according to one or more aspects of the present invention.
Figure 6B:
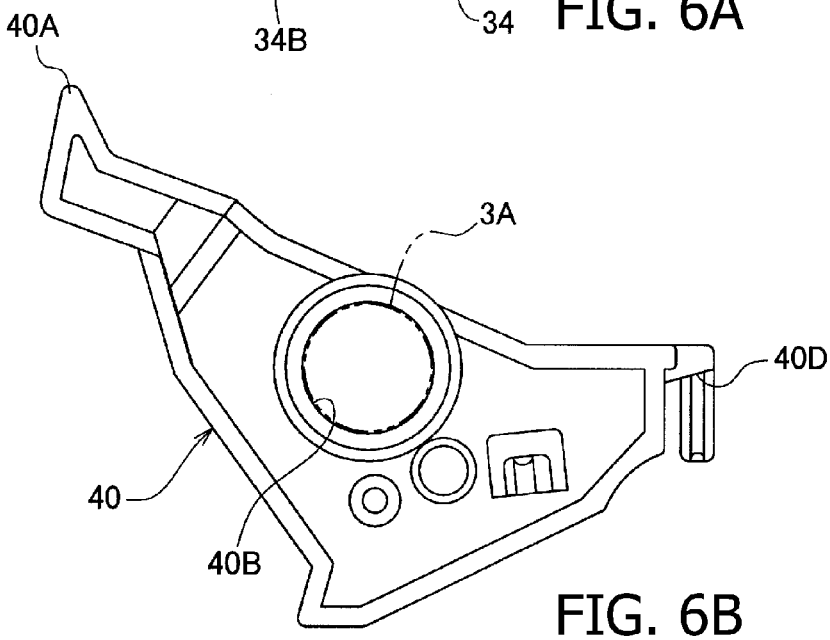
FIG. 6B is a front view showing a configuration of a swing member in the embodiment according to one or more aspects of the present invention.
Figure 6C:
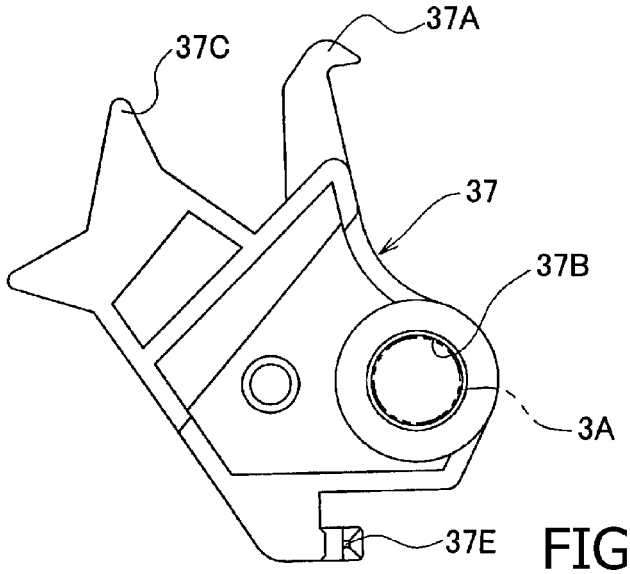
FIG. 6C is a front view showing a configuration of an engagement arm in the embodiment according to one or more aspects of the present invention.

As shown in FIG. 6C, the engagement arm 37 includes a claw portion 37A configured to engage with the projections of the engagement portion 36G, and a bearing configured such that a swing shaft 3A provided to the apparatus main body is inserted thereinto. Thus, the engagement arm 37 is allowed to swing around the bearing 37B between the engagement position and the separation position.

As shown in FIG. 5, the swing motion of the engagement arm 37 is mechanically controlled by a cam tube 38 that has a cam surface 38A on an outer circumferential surface thereof. Specifically, the engagement arm 37 includes a sliding-contact portion 37C configured to slide in contact with the cam surface 38A, and a spring hook 37E configured to be linked with one end of a spring 37D. The spring 37D is configured to apply a force to press the sliding-contact portion 37C against the cam tube 38 and a force to press the claw portion 37A against the engagement portion 36G in a state where the other end of the spring 37D is fixed to the apparatus main body.

Figure 7:
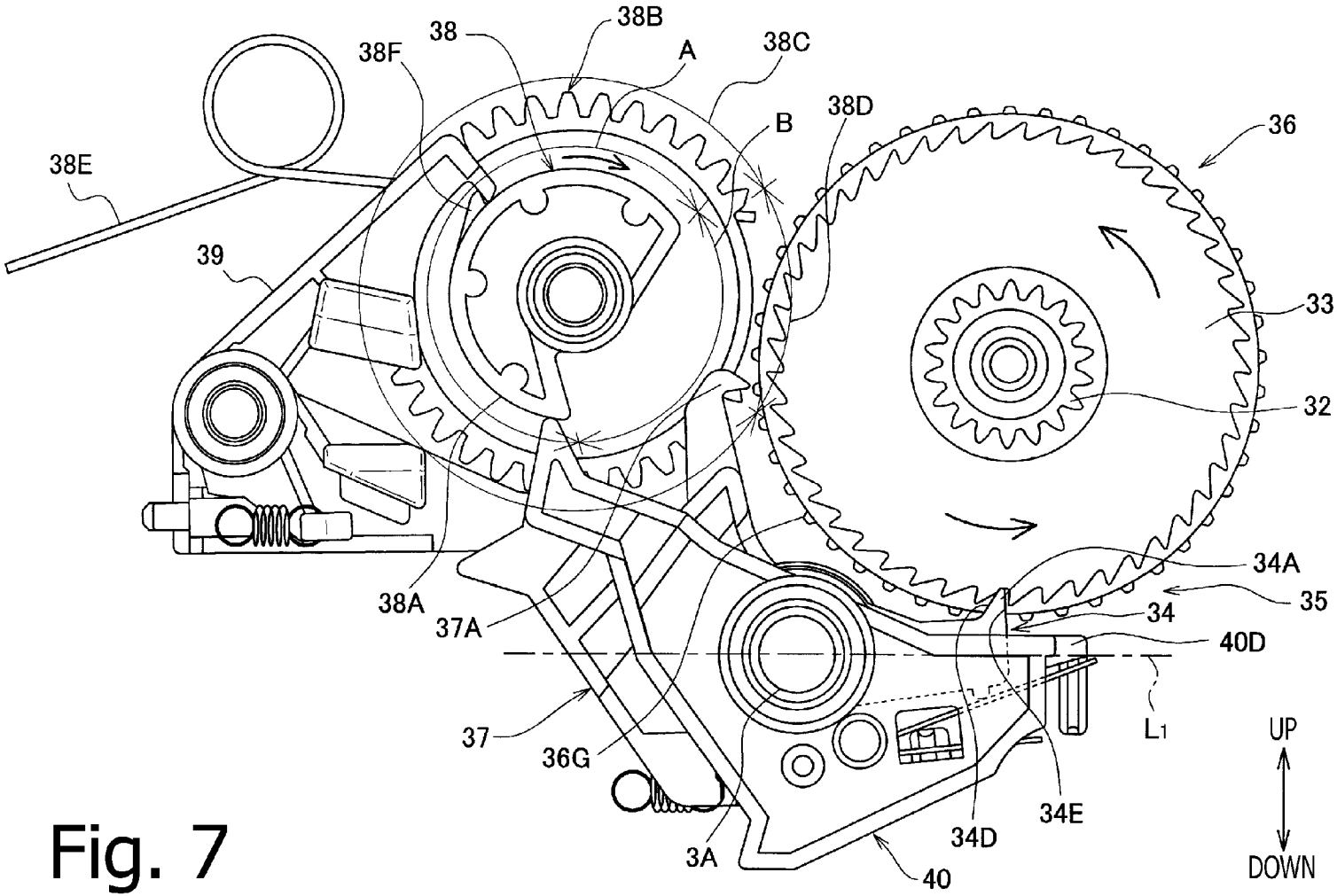
Figure 8:
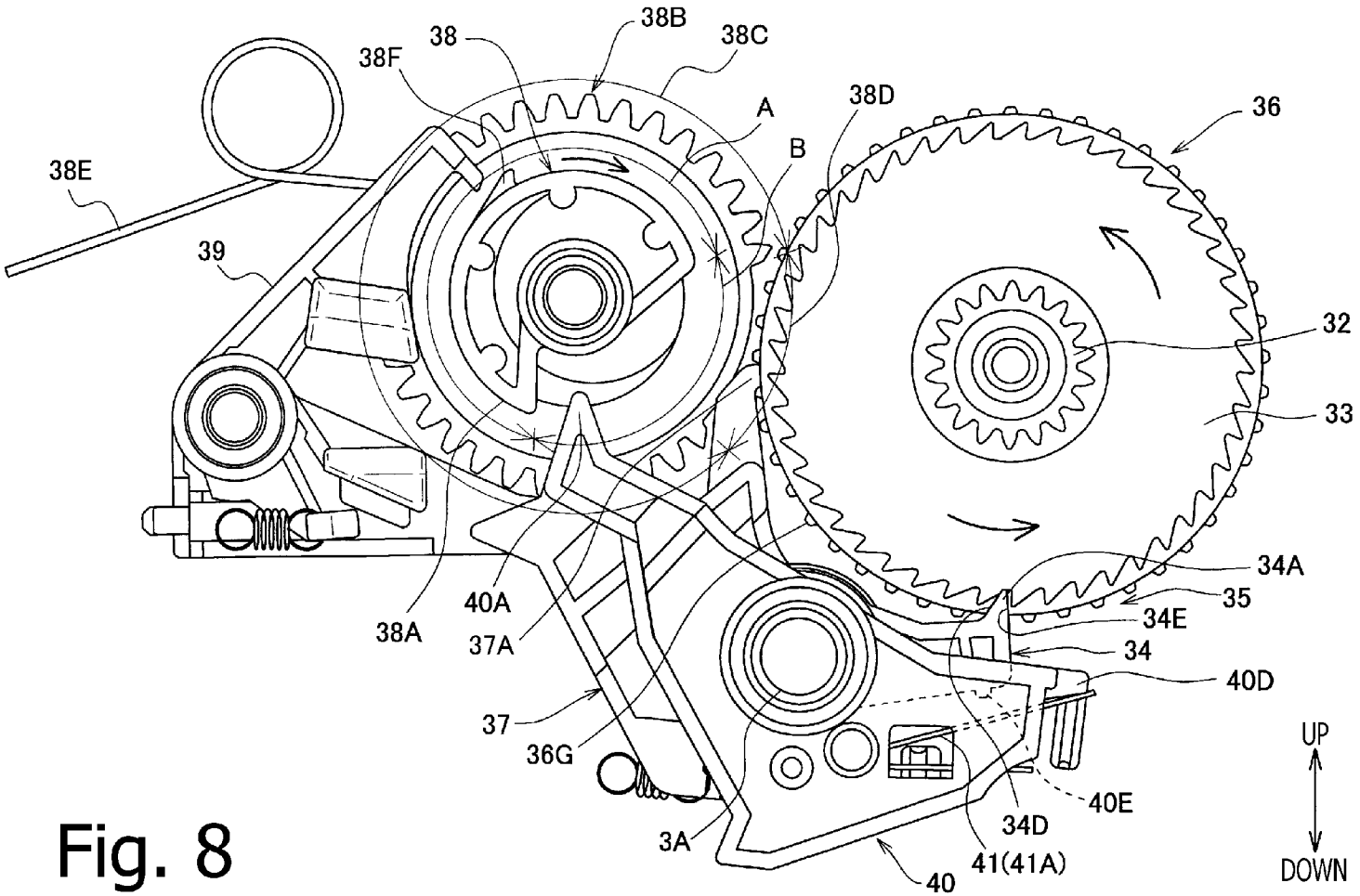

Therefore, in response to rotation of the cam tube 38, as shown in FIG. 7, the claw portion 37A is separated from the engagement portion 36G when the sliding-contact portion 37C is in contact with a cylindrical portion A of the cam surface 38A. Meanwhile, as shown in FIG. 8, the claw portion 37A is engaged with the engagement portion 36G.

Namely, when the sliding-contact portion 37C contacts the cylindrical portion A of the cam surface 38A, the holder 36D is allowed to rotate such that the transmission of the driving force from the input gear 31 to the output gear 32 is interrupted. Meanwhile, when the sliding-contact portion 37C is within a region of a cutout portion B of the cam surface 38A, the holder 36D is forbidden to rotate such that the driving force is transmitted from the input gear 31 to the output gear 32.

Further, as shown in FIG. 3, at one end in the axial direction of the cam tube 38, there is provided a cam gear 38B configured to rotate integrally with the cam tube 38. As shown in FIG. 7, the cam gear 38B is a tooth-lacking gear that includes a tooth portion 38C having teeth configured to engage with the input gear 31, and a tooth-lacking portion 38D having no tooth.

As indicated by an alternate long and two short dashes arrow in FIG. 3, a spring 38E such as a torsion coil spring is configured to always apply a force directed to rotate the cam gear 38B. As shown in FIG. 3, on an outer circumferential surface of the cam tube 38, there is provided a projection 38F configured to engage with a cam stopper arm 39.

The cam stopper arm 39 is configured to engage with the projection 38F and restrict the cam gear 38B from rotating, against an elastic force of the spring 38E. The cam stopper arm 39 is attached to the apparatus main body so as to move between a position separate from the projection 38F, that is, the outer circumferential surface of the cam tube 38 and a position where the cam stopper arm 39 is close to or in contact with the outer circumferential surface of the cam tube 38 to engage with the projection 38F.

As shown in FIG. 5, a spring 39A is configured to apply to the cam stopper arm 39 a force to swing the cam stopper arm 39 toward the projection 38F. Meanwhile, the roller swing arm 27C is configured to apply to the cam stopper arm 39 a force directed to separate the cam stopper arm 39 from the outer circumferential surface of the cam tube 38 when the second end (the right end) in the longitudinal direction of the roller swing arm 27C moves higher than a previously-set position therefor.

<Operations of Clutch Mechanism>

When the second end (the right end) in the longitudinal direction of the roller swing arm 27C moves higher than the previously-set position (i.e., when the pickup roller 17 moves lower than a previously-set position therefor), as shown in FIG. 8, the engagement between the cam stopper arm 39 and the projection 38F is released. Therefore, the cam tube 38 and the cam gear 38B begin to be rotated by the elastic force of the spring 38E.

Then, as the sliding-contact portion 37C moves into the region of the cutout portion B, the holder 36D is forbidden to rotate, such that the driving force is transmitted from the input gear 31 to the output gear 32. Accordingly, the pressing plate 15B begins to move upward.

Figure 9:
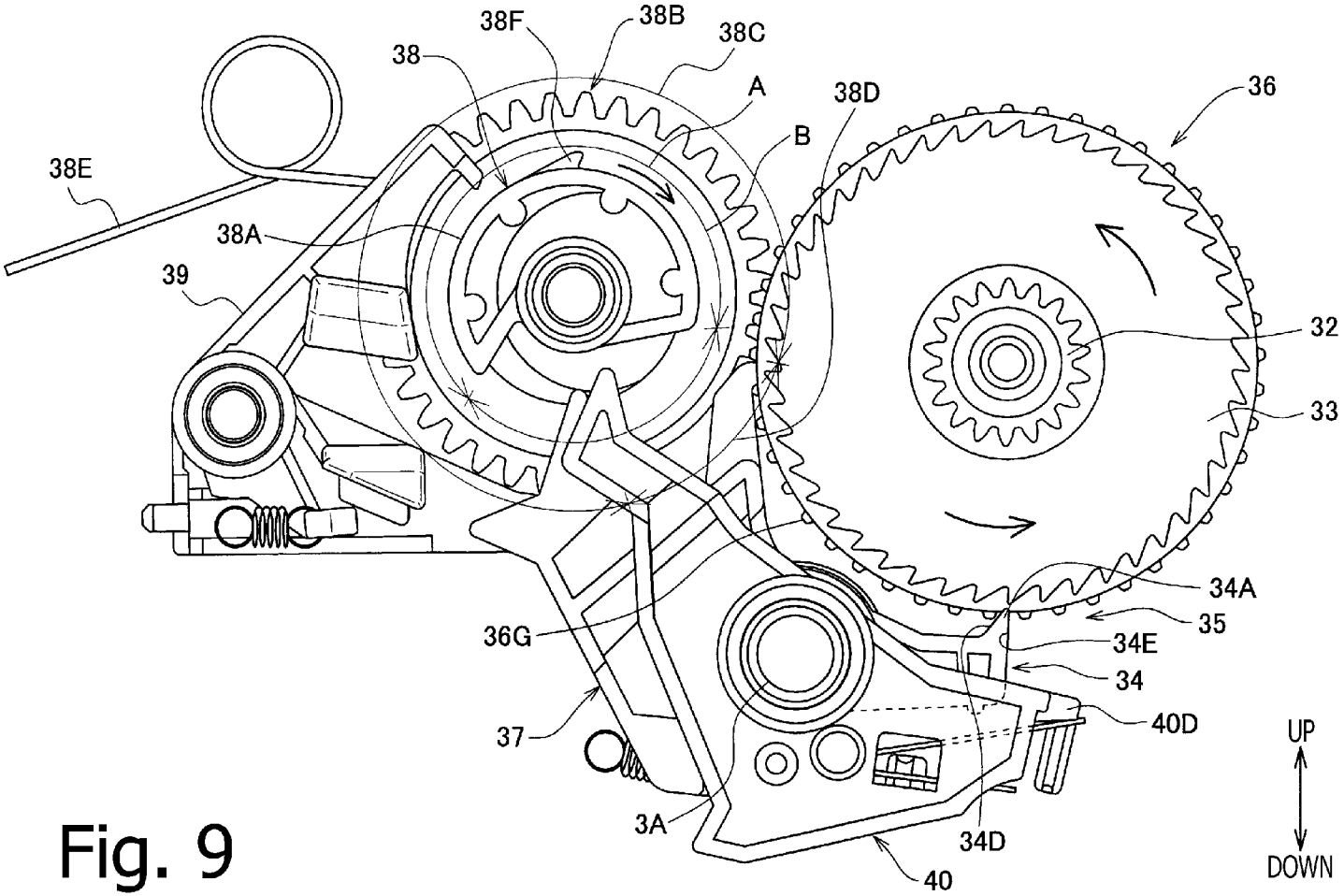

Then, when the cam tube 38 and the cam gear 38B further rotate, as shown in FIG. 9, the engagement between the tooth portion 38C of the cam gear 38B and the input gear 31 is established. Thereby, the cam tube 38 and the cam gear 38B are rotated by the driving force from the input gear 31. It is noted that, at this time, as the sliding-contact portion 37C is within the cutout portion B, the pressing plate 15B continues to move upward.

Figure 10:
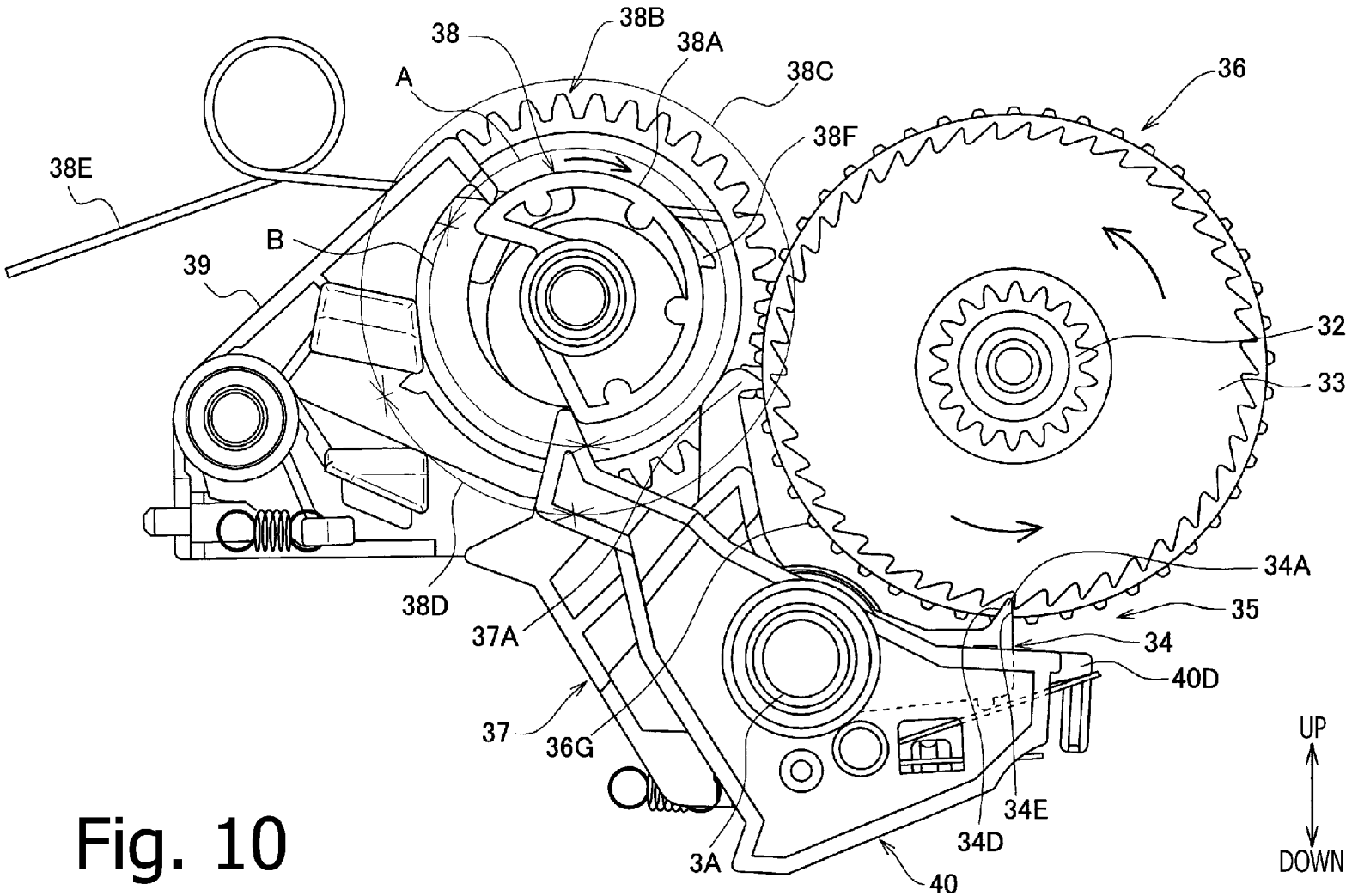

When the cam tube 38 and the cam gear 38B further rotate from the state shown in FIG. 9, as shown in FIG. 10, the sliding-contact portion 37C begins to move into the region of the cylindrical portion A, and the claw portion 37A is separated from the engagement portion 36G. Thereby, the holder 36D is allowed to rotate such that the transmission of the driving force from the input gear 31 to the output gear 32 is interrupted. Accordingly, the upward motion of the pressing plate 15B is stopped.

Then, when the cam tube 38 and the cam gear 38B further rotate, the tooth-lacking portion 38D of the cam gear 38B faces to the input gear 31, and the cam stopper arm 39 engages with the projection 38F. Hence, as shown in FIG. 7, the rotations of the cam tube 38 and the cam gear 38B are stopped.

As described above, when the pickup roller 17 moves lower than the previously-set position therefor, the cam tube 38 and the cam gear 38B rotate while changing their states as shown in the order of FIGS. 8, 9, 10, and 7. Thereby, the pressing plate 15B is moved upward by a predetermined distance.

2. 3. Latchet Mechanism

<Overall Operations of Latchet Mechanism>

The latchet mechanism 35 is configured to restrict the pressing plate 15B from moving downward by the engagement between the latchet gear 33 and the latching member 34, when the transmission of the driving force from the input gear 31 to the output gear 32 is interrupted.

Then, when the driving force is transmitted from the input gear 31 to the output gear 32, and the pressing plate 15B moves upward, the engagement between the latchet gear 33 and the latching member 34 is released, and the latching member 34 is placed in a position separate from (in non-contact with) the latchet gear 33.

<Configuration of Latchet Mechanism>

The latchet gear 33 is integrated with the inner gear 36B of the clutch mechanism 36. As shown in FIG. 6A, the latching member 34 includes a claw section 34A, a bearing section 34B, and an arm section 34C.

The bearing section 34B is configured such that the swing shaft 3A provided to the apparatus main body is inserted thereinto. The arm section 34C is an arm extending toward the latchet gear 33 from the bearing section 34B (or the swing shaft 3A). The claw section 34A is provided at a distal end in the extending direction of the arm section. The claw section 34A is configured to engage with the latchet gear 33 when the transmission of the driving force from the input gear 31 to the output gear 32 is interrupted. The claw section 34A, the bearing section 34B, and the arm section 34C are integrally formed of resin.

In a state where the latching member 34 engages with the latchet gear 33 (i.e., the claw portion 34A engages with the teeth of the latchet gear 33), as indicated by an alternate long and short dash line L1 in FIG. 7, the longitudinal direction of the arm section 34C extends horizontally.

Meanwhile, the axis line direction of the swing shaft 3A (or the bearing section 34B) is coincident with the horizontal direction perpendicularly intersecting the alternate long and short dash line L1. Further, the swing shaft 3A is disposed lower than the latchet gear 33. Therefore, the latching member 34 is allowed to swing up and down around the swing shaft 3A.

As shown in FIG. 6A, the claw section 34A of the latching member 34 is formed substantially in a right triangle shape with a slanted section 34D thereof facing the swing shaft 3A, when viewed along a direction parallel to the axis line direction of the swing shaft 3A.

Additionally, as shown in FIG. 7, the engagement arm 37 and a swing member 40 are swingably attached to the swing shaft 3A. Therefore, the latching member 34 is attached to be swingable up and down relative to the swing member 40.

As shown in FIG. 6B, the swing member 40 includes a sliding-contact section 40A configured to slide in contact with the cam surface 38A, and a bearing section 40B configured to bear the swing shaft 3A inserted thereinto. As shown in FIGS. 11A and 11B, the sliding-contact section 40A is disposed on an opposite side of the claw section 34A with respect to the swing shaft 3A.

Therefore, when the sliding-contact section 40A moves in such a direction as to be closer to the latchet gear 33, as shown in FIG. 8, a right end portion of the swing member 40 that is an end portion close to the claw section 34A (hereinafter referred to as a "claw-section-side portion") moves in such a direction as to be farther away from the latchet gear 33. Meanwhile, when the sliding-contact section 40A moves in such a direction as to be farther away from the latchet gear 33, as shown in FIG. 7, the claw-section-side portion of the swing member 40 moves in such a direction as to be closer to the latchet gear 33.

In addition, the swing member 40 is configured such that the gravity force applied thereto causes a moment that urges the sliding-contact section 40A to move in such a direction as to be closer to the latchet gear 33. Further, the swing member 40 is connected with a spring (not shown) that applies to the swing member 40 a force for pressing the sliding-contact section 40A against the cam surface 38A.

Therefore, when the cam tube 38 and the cam gear 38B rotate, the sliding-contact portion 37C of the engagement arm 37 and the sliding-contact section 40A of the swing member 40 move while tracing the cam surface 38A. Thus, the engagement arm 37 and the swing member 40 swing in mechanical synchronization with each other.

Hereinafter, a position of the swing member 40 where the driving force is allowed to be transmitted from the input gear 31 to the output gear 32 such that the pressing plate 15B moves upward will be referred to as a first position. In addition, a position of the swing member 40 where the transmission of the driving force from the input gear 31 to the output gear 32 is interrupted such that the pressing plate 15B is forbidden to move upward will be referred to as a second position.

Therefore, when the swing member 40 is in the second position, as shown in FIG. 7, the claw-section-side portion of the swing member 40 is rendered closer to the latchet gear 33 than when the swing member 40 is in the first position. Meanwhile, when the swing member 40 is in the first position, as shown in FIG. 8, the claw-section-side portion of the swing member 40 is rendered farther away from the latchet gear 33 than when the swing member 40 is in the second position.

As shown in FIGS. 11A and 11B, an elastic member 41 such as a torsion coil spring is attached to the swing member 40. The elastic member 41 includes a rod-shaped acting portion 41A that extends from the side of the swing shaft 3A to the side of the claw section 34A, a coil portion 41B provided at one end in the longitudinal direction of the acting portion 41A, and a held portion 41C that extends from the coil portion 41B to the same side as the acting portion 41A and is held by the swing member 40.

Into the coil portion 41B, inserted is a cylindrical boss 40C provided to the swing member 40. Meanwhile, a distal end in the extending direction of the acting portion 41A is held by a restricting portion 40D. The restricting portion 40D is configured to contact the distal end of the acting portion 41A from the side of the latching member 34 and restrict the acting portion 41A from moving toward the latching member 34.

The latching member 34 includes a projection 40E that protrudes toward the acting portion 41A. As shown in FIG. 7, when the swing member 40 is in the second position, the projection 40E applies, to the latching member 34, an elastic force (a pressing force) for pressing the latching member 34 against the latchet gear 33 (more specifically, the projection 40E transmits the pressing force from the acting portion 41A to the latching member 34 therethrough).

<Detailed Operations of Latchet Mechanism>

When the swing member 40 is in the second position, the sliding-contact section 40A contacts the cam surface 38A. Therefore, as shown in FIG. 7, a side of the swing member 40 that is close to the restricting portion 40D is placed in a position close to the latchet gear 33. Hence, the acting portion 41A of the elastic member 41 contacts the projection 40E of the latching member 34 and applies the pressing force to the latching member 34.

When the swing member 40 swings from the second position to the first position, as shown in FIG. 8, the acting portion 41A (the elastic member 41) swings downward integrally with the swing member 40 so as to be farther away from the latchet gear 33. Thus, the acting portion 41A is separated from the projection 40E.

Then, when the swing member 40 is placed into the first position, the acting portion 41A of the elastic member 41 is not allowed to apply the pressing force. Thereby, the latching member 34 is put into a state swingable relative to the swing member 40, and the claw section 34A is separated from the latchet gear 33. Thus, the engagement between the claw section 34A and the latchet gear 33 is released.

Namely, when the swing member 40 is placed into the first position, the driving force is transmitted from the input gear 31 to the output gear 32, such that the latchet gear 33 rotates in such a direction as to move the pressing plate 15B upward.

Thereby, the claw section 34A of the latching member 34 moves downward along a slanted surface of a tooth of the latchet gear 33. Further, owing to the gravity force applied to the latching member 34, the moment for separating the latching member 34 from the latchet gear 33 is applied to the latching member 34. Thus, the claw section 34A is separated from the latchet gear 33.

3. Features of Image Forming Apparatus

In the embodiment, as described above, when the swing member 40 is in the second position, the pressing force is applied to the latching member 34. Therefore, it is possible to certainly hold the engagement between the latchet gear 33 and the latching member 34.

Further, in the embodiment, when the swing member 40 is in the first position, the pressing force is not applied to the latching member 34, and the latching member 34 is movable relative to the swing member 40.

Therefore, at the same time as the latchet gear 33 rotates, the latching member 34 is rendered separate from the latchet gear 33 upon receipt of a rotational force of the latchet gear 33. Namely, in the embodiment, nearly at the same time as the swing member 40 is placed into the first position, the latching member 34 is separated from the latchet gear 33.

Accordingly, in the embodiment, it is possible to separate the latching member 34 from the latchet gear 33 at an appropriate separation moment without having to provide any contact portion to the swing member 40. Thus, it is possible to prevent an abnormal sound from being caused by collision between a tooth of the latchet gear 33 and the latching member 34 and to avoid a rise in the manufacturing cost of the image forming apparatus.

Further, in the embodiment, the elastic member 41 is attached to the swing member 40 and configured to swing integrally with the swing member 40. Thereby, in the embodiment, the elastic member 41 moves in conjunction with the swing motion of the swing member 40. Therefore, it is possible to easily eliminate the pressing force applied to the latching member 34, at an appropriate moment.

Further, in the embodiment, the latching member 34 is attached to be swingable up and down relative to the swing member 40. Moreover, the swing axis (the swing shaft 3A) of the latching member 34 is disposed lower than the latchet gear 33.

Thereby, in the embodiment, as described above, the gravity force applied to the latching member 34 acts as a force to separate the latching member 34 from the latchet gear 33. Therefore, it is possible to certainly separate the latching member 34 from the latchet gear 33 and to certainly maintain a separation state where the latching member 34 is separated from the latchet gear 33 after the latching member 34 is put into the separation state. Accordingly, it is possible to certainly prevent occurrence of an abnormal sound.

Further, in the embodiment, in a situation where the latching member 34 engages with the latchet gear 33, the arm section 34C extends horizontally. Thereby, in the embodiment, it is possible to make the gravity force applied to the latching member 34 effectively function as a force to separate the latching member 34 from the latchet gear 33.

It is noted that the expression "the arm section 34C extends horizontally" may represent a situation where the arm section 34C extends in a substantially horizontal direction (such as a direction different from the horizontal direction by an angle of 10 degrees) as well as a situation where the arm section 34C extends in the definitely horizontal direction. Further, in the embodiment, the claw section is formed in a right triangle shape when viewed along the direction parallel to the axis line direction of the swing shaft 3A.

Thereby, in the embodiment, as shown in FIG. 7, since a vertical section 34E of the claw section 34A is substantially parallel to the vertical direction, it is possible to easily separate the latching member 34 from the latchet gear 33. Accordingly, when the swing member 40 is placed into the first position, and a rotational force is applied to the latchet gear 33, nearly at the same time, the latching member 34 is separated from the latchet gear 33. Thus, it is possible to certainly prevent occurrence of an abnormal sound.

It is noted that the expression "the claw section is formed in a right triangle shape when viewed along a direction parallel to the axis line direction of the swing shaft 3A" may represent a situation where the claw section is formed substantially in a right triangle shape when viewed through an eye observation along a direction parallel to the axis line direction of the swing shaft 3A. The term "a right triangle shape" does not necessarily have to represent a definitely right triangle shape.

Further, in the embodiment, the latching member 34 is provided with the projection 40E that protrudes toward the acting portion 41A and configured to apply the pressing force to the latching member 34 when the swing member 40 is in the second position.

Thereby, in the embodiment, the pressing force is applied to the latching member 34 via the projection 40E. Therefore, it is possible to reduce the variation in the position of the latching member 34 to which the pressing force is applied. Thus, it is possible to stably operate the latching member 34.

Further, in the embodiment, the swing member 40 is provided with the restricting portion 40D configured to contact the acting portion 41A from the side of the latching member 34 and restrict the acting portion 41A from moving toward the latching member 34.

Thereby, in the embodiment, it is possible to certainly restrict the pressing force from being applied to the latching member 34 when the swing member 40 is in the first position.

Further, in the embodiment, the slanted section 34D of the claw section 34A faces the swing shaft 3A when viewed along a direction parallel to the axis line direction of the swing shaft 3A.

Thereby, in the embodiment, when the swing member 40 is in the second position, the force applied to the vertical section 34E of the claw section 34A is directed toward the swing shaft 3A. Meanwhile, the force applied to the vertical section 34E is based upon a force in such a direction as to move the pressing plate 15B downward.

Accordingly, when the swing member 40 is placed into the first position such that the rotational force is applied to the latchet gear 33, as shown in FIG. 8, the force applied to the vertical section 34E of the claw section 34A disappears. Further, at the same time, a frictional force generated at the vertical section 34E disappears. Therefore, nearly at the same time as the swing member 40 is placed into the first position, the latching member 34 is rendered separate from the latchet gear 33. Thereby, it is possible to certainly prevent occurrence of an abnormal sound.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present invention. It is to be understood that the present invention is capable of use in various other combinations and environments and is capable of changes or modifications within the scope of the inventive concept as expressed herein. For example, the following modifications are possible.

(Modifications)

In the aforementioned embodiment, the restricting portion 40D is provided. However, in order to restrict the elastic member 41 from applying the pressing force to the latching member 34 when the swing member 40 is in the first position, for example, the elastic member 41 may be configured such that the acting portion 41A is separated from the projection 40E in a natural state of the elastic member 41, without the restricting portion 40D.

In the aforementioned embodiment, a torsion coil spring is employed as the elastic member 41. However, the elastic member 41 may be a plate spring having only an element corresponding to the acting portion 41A.

In the aforementioned embodiment, the elastic member 41 is attached to the swing member 40. However, for instance, the elastic member 41 may be attached to the latching member 34. Further, in the aforementioned embodiment, the latching member 34 and the swing member 40 are disposed on a side lower than the latchet gear 33. However, the latching member 34 and the swing member 40 may be disposed on a side higher than the latchet gear 33.

In the aforementioned embodiment, aspects of the present invention are applied to a monochrome laser printer. However, aspects of the present invention may be applied to other types of image forming apparatuses such as a color laser printer and an inkjet printer.

What is claimed is:

1. An image forming apparatus comprising:

an image forming unit configured to form an image on a sheet;

a loading unit configured to be loaded with a plurality of sheets stacked thereon;

a feed roller disposed above the loading unit, the feed roller being configured to contact the sheets stacked on the loading unit and feed the sheets toward the image forming unit;

a pressing plate configured to move upward the sheets stacked on the loading unit;

a swing member configured to swing between:

a first position where a force for moving the pressing plate upward is transmitted to the pressing plate, and a second position where transmission of the force to the pressing plate is interrupted;

a latchet mechanism configured to forbid the pressing plate to move downward, the latchet mechanism comprising:

a latchet gear configured to rotate in conjunction with a motion of the pressing plate; and a latching member movably attached to the swing member, the latching member being configured to forbid rotation of the latchet gear by engaging with the latchet gear; and a pressing member configured to:

when the swing member is in the second position, apply to the latching member a pressing force to press the latching member against the latchet gear, and when the swing member is in the first position, not apply the pressing force to the latching member, and render the latching member movable relative to the swing member.

2. The image forming apparatus according to claim 1, wherein the pressing member is attached to the swing member and configured to swing integrally with the swing member.

3. The image forming apparatus according to claim 2, wherein the latching member is attached to be swingable up and down relative to the swing member around a swing shaft disposed lower than the latchet gear.

4. The image forming apparatus according to claim 3, wherein the latching member comprises:

an arm section that extends from the swing shaft toward the latchet gear; and a claw section provided at a distal end of the arm section in a direction in which the arm section extends, and wherein the arm section is configured to extend substantially horizontally in a state where the latching member engages with the latchet gear.

5. The image forming apparatus according to claim 4, wherein the claw section is formed substantially in a right triangle shape when viewed along a direction parallel to an axis line direction of the swing shaft.

6. The image forming apparatus according to claim 5, wherein the pressing member comprises an acting portion that extends from a side of the swing shaft to a side of the claw section, and wherein the image forming apparatus further comprises a projection provided to one of the latching member and the acting portion, the projection being configured to protrude toward a different one of the latching member and the acting portion such that the pressing force is applied to the latching member via the projection when the swing member is in the second position.

7. The image forming apparatus according to claim 6, wherein the swing member comprises a restricting portion configured to restrict the acting portion from moving toward the latching member.

8. The image forming apparatus according to claim 5, wherein the claw section comprises a slanted section formed to face the swing shaft when viewed along the direction parallel to the axis line direction of the swing shaft.

* * * * *